US005148132A

United States Patent [19]

Chapell

[11] Patent Number: 5,148,132

[45] Date of Patent: Sep. 15, 1992

[54] MICROWAVE COUPLER

[75] Inventor: Harry F. Chapell, Maynard, Mass.

[73] Assignee: Sage Laboratories, Inc., Natick, Mass.

[21] Appl. No.: 647,479

[22] Filed: Jan. 29, 1991

[51] Int. Cl.[5] ..... H01P 5/18

[52] U.S. Cl. ..... 333/115; 333/243

[58] Field of Search ..... 174/102 A, 102 R, 110 FC, 174/113 R; 333/115, 243, 244

[56] References Cited

U.S. PATENT DOCUMENTS

| | | | |
|---|---|---|---|
| 3,358,248 | 12/1967 | Saad | 333/115 |
| 4,547,753 | 10/1985 | Chapell | 333/115 |
| 4,641,111 | 2/1987 | Chapell | 333/115 |

FOREIGN PATENT DOCUMENTS

| | | | |
|---|---|---|---|
| 2178905 | 2/1987 | United Kingdom | 333/115 |

OTHER PUBLICATIONS

Sage Laboratories Blueprints for Model 780-30B, May 19, 1963.

*Primary Examiner*—Steven Mottola

*Attorney, Agent, or Firm*—Wolf, Greenfield & Sacks

[57] ABSTRACT

An insulating sleeve for a microwave coupler having two proximately positioned inner conductors, an outer conductor and the sleeve disposed between the conductors and in contact with them. The material from which the sleeve is constructed is electrically insulating and includes a coefficient of linear thermal expansion that is no more than 1.5 times that of the outer conductor in an operating temperature range. The outer conductor may be a copper-based alloy or aluminum and the insulating sleeve material may be, among others, Fluorosint ® 500 or Flurolly H ®.

35 Claims, 1 Drawing Sheet

MICROWAVE COUPLER

BACKGROUND OF THE INVENTION

1. Field of the Invention

The present invention relates in general to coupled line devices such as may be used in constructing quadrature hybrids and couplers including directional couplers. More particularly, the present invention relates to an improved microwave coupler construction having improved temperature thermal expansion characteristics.

2. Background Discussion

A highly effective form of microwave coupling device applicable to a range of frequencies, centered around a predetermined frequency, involves the use of a pair of wire like inner conductors with at least one of the conductors containing insulation. These two inner conductors are placed in contact with each other along their lengths and are usually slightly twisted around one another to maintain their relative positioning. About this pair of inner conductors is placed a pliable insulating sleeve composed usually of a Tetrafluroethylene (TFE) based material such as Teflon ®. This sleeve and the conductors therein are housed in a shielding outer conductor composed generally of a copper-based alloy or aluminum. Such a microwave conductor is disclosed in U.S. Pat. Nos. 3,358,248 and 4,547,753.

A significant problem with such a microwave coupler is that it is subjected to a fairly wide range of operating temperatures (as much as $-55°-+85°$ C.) during use. Higher internal temperatures may be attained with high energy couplings or even during soldering of the coupler onto a printed circuit board. As such, the parts of the coupler tend to expand and contract at various times during the operation. Since the coupler is usually elongated and open at either end, expansion is particularly pronounced in an axial elongation direction. The outer conductor, is generally composed of a copper-based alloy or aluminum. Copper alloy has a coefficient of linear thermal expansion in the operating temperature range of approximately $1.6\times10^{-5}$/°C. Aluminum has a coefficient of approximately $2.4\times10^{-5}$/°C. In contrast, standard Teflon ® has a coefficient of linear thermal expansion of approximately $9\times10^{-5}$/°C. Thus, any expansion of the outer conductor may be amplified by more than five times in the Teflon ®. This differential expansion can cause the insulating sleeve to significantly bulge out of either end of the outer conductor tube resulting in mechanical strain and islocation of the inner conductor wires.

A typical microwave coupler 100 mounted on a circuit board 101 is shown in FIG. 4. The outer conductor leads 102, 104, 106, 108 extend out opposing uncapped ends 110, 112 of the coupler 100. The outer conductors 102, 104, 106, 108 are encased in an insulating sleeve 114. The metallic outer conductor 116 snugly fits over the sleeve 114. The leads 102, 104, 106 and 108 are each mounted to a respective laminated metallic strip 118, 119, 121, 123 on the circuit board 101 generally by means of a solder joint 120. Note that in this four part coupler example, the shield, terminals 106, 108, input 122 and output are each mounted to a common ground. When the coupler operates to transfer RF energy from an input 122 to an output 124, a large amount of heat is generated in the conductor 100 that results in the linear expansion (arrows 126) of the outer conductor 116 and the significantly greater expansion (arrow 128) in the sleeve 114. The effect of expansion is herein illustrated for one end 110 of the coupler 100, but one should assume that the effect is experienced equally by the other end 112. This expansion places pressure (arrows 130) upon the conductor leads (for example 102, 104). Since the leads 102, 104, 106, 108 should remain relatively short to attain good coupler performance, the leads are somewhat taut. Thus, the sleeve pressure 130 creates tension (arrows 132) in the leads 102, 104 consequently placing strain upon the solder joints 120. As noted above, the cyclic loading of these joints may eventually result in loosening or total disconnection of leads from the circuit board strip 118 or 119. Even if the leads experience low tension, the preferred method of mounting allows the sleeve pressure 130 to impart a cyclically acting moment (curved arrows 134) about the solder joints 120. The leads are, in effect, a lever with a fulcrum at the joint 120 and a distal end at the sleeve 114. Eventually, the moments also result in fatigue and joint breakage.

SUMMARY OF THE INVENTION

It is therefore an object of the present invention to provide an insulating sleeve for a microwave coupler having a coefficient of linear thermal expansion that substantially matches that of the outer conducter to prevent mechanical strain of conductor elements.

It is another object of this invention to provide an insulating sleeve that has improved dielectric properties.

It is yet another object of this invention to provide an insulating sleeve that is composed of a readily available and workable material.

This invention provides an insulating sleeve for a microwave coupler having two proximately positioned inner conductors, an outer conductor and the sleeve disposed between them. This insulating sleeve is composed of a material surrounding and in contact with the two proximately positioned inner conductors and extending radially to contact an outer conductor. This material is electrically insulating and has a coefficient of linear thermal expansion that substantially matches that of the outer conducter in an operating temperature range for the coupler. Preferably, the coefficient of linear thermal expansion of the insulating sleeve is no more than 1.5 times that of the outer conductor.

In a preferred embodiment the outer conductor is a copper based or aluminum metal having a coefficient of linear thermal expansion in the operating temperature range of $1.6\times10^{-5}$/°C. or $2.4\times10^{-5}$/20 C. respectively.

This invention may also provide an insulating sleeve composed of material having a predetermined coefficient of linear thermal expansion that substantially equalizes temperature induced linear displacement of the insulating sleeve with that of the outer conductor in a normal microwave coupler operating temperature range to prevent permanently deforming strain of coupler components. The outer conductor herein may be a copper-based or aluminum metal having in the operating temperature range a coefficient of thermal linear expansion of approximately $1.6\times10^{-5}$/°C. or $2.4\times10^{-5}$/°C. respectively. The insulating sleeve may be composed of a TFE-based polymer compound. This insulating sleeve may have a dielectric constant of 2.9-3.6. The TFE based polymer compound may include a synthetic mica filler to alter its coefficient of linear thermal expansion. This compound may be Fluorosint® 500. Alternatively, the sleeve may be composed of a boron nitride TFE compound such as Flurolloy H®.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENT

Figure 1:
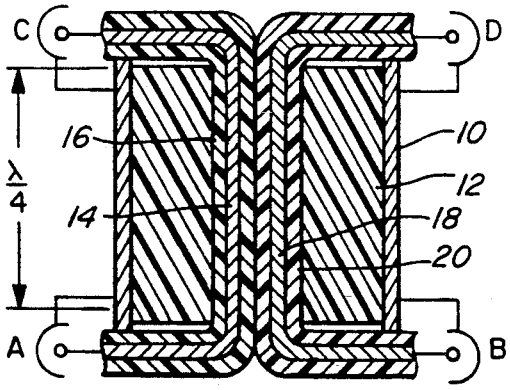
FIG. 1 is a longitudinal sectional view of a microwave coupler having a low thermal expansion insulating sleeve according to this invention.
Figure 4:
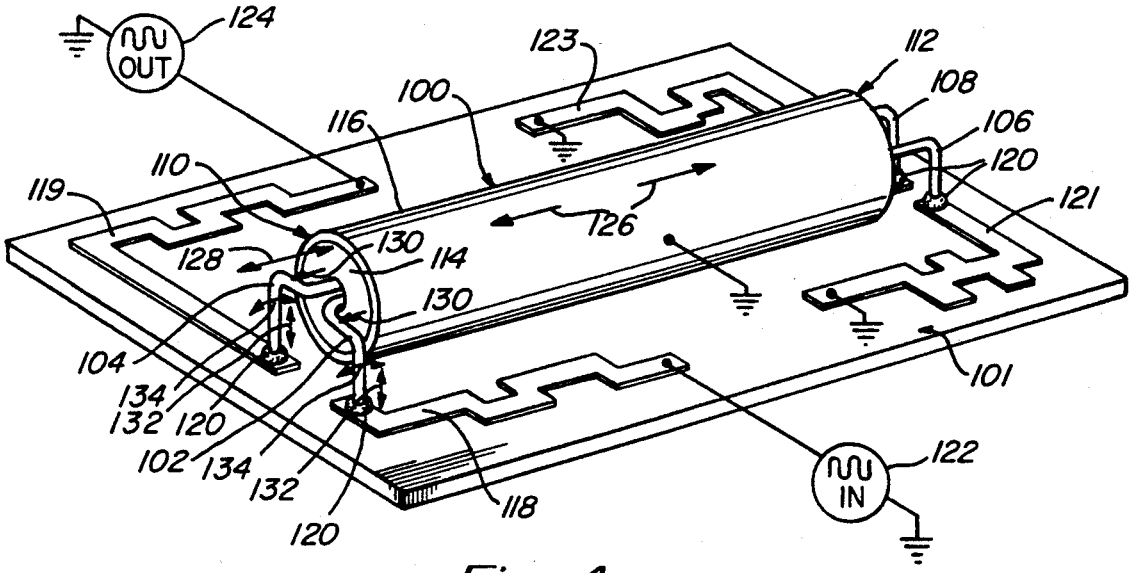
Fig. 4 (PRIOR ART)
FIG. 4 is a perspective view of a prior art coupler mounted on a circuit board illustrating the strains in the leads generated by differential expansion.

A microwave coupler having an insulating sleeve 12 is depicted in FIG. 1. The sleeve 12 is disposed between a pair of adjacent inner conductors 16 and 18 separated only by their insulation 14 and 20. An outer conductor 10 generally composed of a copper based or other electrically shielding metal surrounds the sleeve. Each side of the coupler is connected to a pair of terminals, (A and C) and (B and D), respectively. For illustration refer also to FIG. 4.

The coupler may be specifically tuned to a certain frequency and operates within a range around that frequency. This frequency may be tuned in by setting the axial length of the coupler equal to an even multiple of the signal wavelength which in this example is ¼ wavelength $\lambda/4$. This translates into a coupler size usually in the range of 1–3 inches in length.

Figure 2:
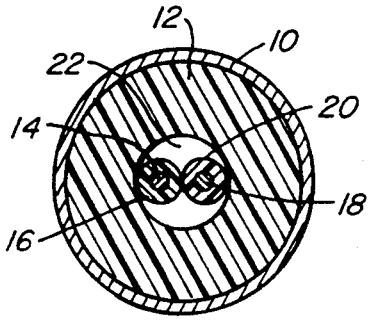
FIG. 2 is a cross-sectional view of the microwave coupler with the insulating sleeve of FIG. 1.
Figure 3:
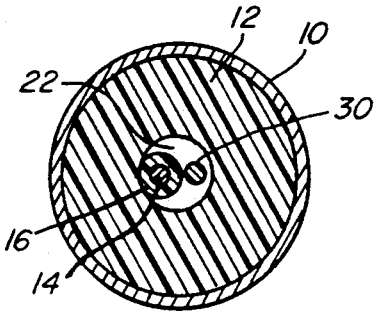
FIG. 3 is a cross sectional view of an alternative embodiment of a microwave coupler having an insulating sleeve according to this invention wherein only one of the inner conductors has insulation disposed about its perimeter.

A cross-sectional view of the coupler of FIG. 1 is depicted in FIG. 2. The sleeve is shown having a circular hole 22 at its center through which the inner conductors are placed. The two inner conductors may be braided about each other with a slight twist in order to firmly secure them in position. Another embodiment of the coupler, shown in FIG. 3, is substantially identical to that shown in FIG. 2 except that only one inner conductor 14 has insulation 16 disposed about it. A second inner conductor 30 is placed in contact with this first inner conductor 14, separated only by its insulation 16.

Since the inner conductors are in close contact with the sleeve 12, a significant amount of heat is generated that is directly transferred by conduction to the sleeve. As a result the sleeve is subject to significant thermal expansion (as much as 0.01 inches for an aluminum 3 inch coupler in a normal operating temperature range of approximately −55°–+85° C.) The thermal expansion in an ordinary Teflon® sleeve can be more than five times that of the outer conductor causing mechanical strains upon the coupler elements, particularly the inner conductor leads, that may result in its disconnection from circuit board terminals. This inner expansion may be even more pronounced during the actual soldering process in which the coupler is attached to a circuit board.

To reduce the differential of thermal expansion, a modified sleeve material is employed according to this invention. One such material uses a standard TFE product such as Teflon® as a base compound but includes a synthetic mica filler that substantially lowers the coefficient of linear thermal expansion. Since the coefficient of linear thermal expansion of copper based alloys and aluminum from which the outer conductor is composed is in the range of, respectively, $1.6\times10^{-5}$/°C. or $2.4\times10^{-5}$/°C., it is desirable to lower the coefficient of the sleeve material to this range of values. A differential of 1.5 times the outer conductor value has been found to be generally acceptable to prevent any undue strains upon the inner conductor wires. A mica filled TFE product named Fluorosint® 500 of the Polymer Corp. has been found to be an effective sleeve material for minimizing thermal expansion. Its coefficient of linear thermal expansion is relatively low, in the range of $2.25-2.7\times10^{-5}$/°C. As such, it about the same as the coefficient for most commonly used aluminum alloys and also substantially closer to the coefficient for copper based alloys.

It is also desirable that the sleeve material maintain a sufficiently high dielectric constant to improve signal synchronization properties. Teflon® has relatively good dielectric properties for microwave coupler use, in the range of 2.0–2.1. However, it has been found that Fluorosint® 500, in addition to providing the improved thermal expansion qualities, also has a dielectric constant in the range of 2.85–3.65, thus providing the improved signal synchronization properties since it more closely matches the insulating material of the wire inner conductors.

Note that for larger couplers, however, the inner conductors may be installed directly in the sleeve without insulators and with a division machined in the sleeve to separate each wire. Thus, it is not as important to attain an exact dielectric constant for the sleeve since there is no inner conductor insulator that must be matched directly. For further details regarding such signal synchronization properties, refer to my earlier U.S. Pat. No. 4,547,753.

An alternative group of insulating materials are boron nitride loaded TFE materials such as Flurocarbon (now Furon) Corporation's Flurolloy H®. The properties of this class of polymers make it an acceptable sleeve material from the standpoint of low thermal expansion (approximately $3.6\times10^{-5}$/°C.

A coupler utilizing a low linear thermal expansion coefficient sleeve material may be constructed by braiding a pair of inner conducting wires, one of which may contain no insulation, and then either wrapping thin layers of the sleeve material about these inner wires and heating to melt the layers together. However, materials such as Fluorosint® 500 may not always be sufficiently pliable to wrap in thin layers. Thus, a sleeve containing wires may be constructed by forming a hole, possibly by drilling, lengthwise down a central axis of a length of Fluorosint® 500 or similar low expansion material preshaped as an inner sleeve. The inner conducting wires are then fed through this elongated hole. The void 22 between the wires and walls of the hole, shown in FIGS. 2 and 3 that would result from a drilling process could be filled with an epoxy, or, preferably, a silicone based material having a sufficiently high dielectric constant, thus providing a firm mounting of the inner conductors as well as more complete insulating coverage. Once the sleeve is fitted with inner conducting wires, the wire and sleeve assembly may be fed into the outer conductor. Since the sleeve is preshaped to fit in the outer conductor, it should slide into it with a minimum of effort. This outer conductor is depicted as a round tube, however it may equally be rectangular in cross section or of some other geometric shape to which the sleeve is fitted, or to which a dielectric epoxy or silicone is added to fill in any gaps between the sleeve and the inner wall of the outer conductor.

It should be understood that the preceding is merely a detailed description of a preferred embodiment. It should be apparent to those skilled in the art that various modifications can be made without departing from the spirit or scope of the invention. The preceding description is meant to describe only a preferred embodiment and not to limit the scope of the invention.

What is claimed is:

1. A microwave coupled line device comprising:

a circuit board having electrically conductive circuit pads disposed thereon;

a microwave coupler positioned on the circuit board and having an outer conductor and a pair of proximately positioned wire-like inner conductors, at least one of the inner conductors having insulation thereon, the inner conductors being separated from the outer conductor by a sleeve adapted to allow the inner conductors to pass therethrough in substantial contact with each other, and the inner conductors being separated from each other only by the thickness of the insulation therebetween, and the sleeve including a pathway to guide the inner conductors to each of opposing open ends of the outer conductor;

the sleeve comprising a dielectric material surrounding and in contact with the pair of inner conductors that is electrically insulating and includes a coefficient of linear thermal expansion that is no more than 1.5 times of the outer conductor in a microwave coupler operating temperature range; and the inner conductors extending at angles from the opposing ends of the outer conductor and the inner conductors being connected to the circuit pads and defining a substantially direct path from the outer conductor to the circuit pads and the inner conductors being substantially free of slack.

2. An insulating sleeve as set forth in claim 1 wherein said outer conductor comprises one of a copper-based alloy and aluminum.

3. An insulating sleeve as set forth in claim 2 wherein said material has a dielectric constant in the range of 2.9–3.6.

4. An insulating sleeve as set forth in claim 3 wherein said material comprises Fluorosint® 500.

5. An insulating sleeve as set forth in claim 2 wherein said material comprises a boron nitride loaded TFE-based compound.

6. An insulating sleeve as set forth in claim 5 wherein said material comprises Flurolloy H®.

7. An insulating sleeve as set forth in claim 1 wherein at least one end of said outer conductor is uncapped with the insulating sleeve and the inner conductors free to extend outwardly therefrom.

8. An insulating sleeve as set forth in claim 7 wherein both ends of said outer conductor are uncapped with the insulating sleeve and the inner conductors free to extend respectively outwardly therefrom.

9. An insulating sleeve as set forth in claim 8 wherein said outer conductor is cylindrical in shape.

10. A microwave coupled line device comprising:

an outer conductor defining a cavity with opposing ends;

a pair of wire-like inner conductor in contact with each other along their respective lengths and the inner conductors passing through the outer conductor cavity from one end to the other opposing end, at least one of the inner conductors having insulation thereon and the inner conductors extending at substantially right angles out of the opposing ends of the outer conductor and the inner conductors connected to a set of electrically conductive contact points external of and separated from the outer conductor, the inner conductors being substantially free of slack along a length thereof between the contact points and the outer conductor; and a sleeve adapted to receive the two inner conductors, the sleeve positioned within the cavity of the outer conductor and separating the inner conductors from the outer conductor, the sleeve comprising a material having a predetermined coefficient of linear thermal expansion that substantially equalizes a temperature dependent linear displacement of the insulating sleeve with that of the outer conductor in a normal microwave coupler operating temperature range so that the inner conductors remain free of deformation damage including contact point separation throughout the microwave coupler operating temperature range.

11. An insulating sleeve as set forth in claim 10 wherein said outer conductor comprises one of a copper-based alloy and aluminum.

12. An insulating sleeve as set forth in claim 11 wherein said material comprises a TFE-based polymer compound.

13. An insulating sleeve as set forth in claim 12 wherein said material has dielectric constant in the range of 2.9–3.6.

14. An insulating sleeve as set forth in claim 13 wherein said compound includes synthetic mica filler to alter its coefficient of linear thermal expansion.

15. An insulating sleeve as set forth in claim 13 wherein said compound comprises Fluorosint® 500.

16. An insulating sleeve as set forth in claim 11 wherein said compound includes boron nitride to alter its coefficient of linear thermal expansion.

17. An insulating sleeve as set forth in claim 16 wherein said compound comprises Flurolloy H®.

18. An insulating sleeve as set forth in claim 10 wherein at least one end of said outer conductor is uncapped with the insulating sleeve and the inner conductors extending outwardly therefrom.

19. An insulating sleeve as set forth in claim 18 wherein both ends of said outer conductor are uncapped with the insulating sleeve and the inner conductors free to extend respectively outwardly therefrom.

20. An insulating sleeve as set forth in claim 19 wherein said outer conductor is cylindrical in shape.

21. A microwave coupled line device operating over a frequency range having a predetermined center frequency and comprising, a printed circuit board having electrically conductive circuit pads positioned thereon, an elongated tubular outer conductor having an opening at each of opposite ends thereof, first and second inner conductors, at least one of which has insulation bonded thereto and the inner conductors separated by the thickness of said insulation therebetween, each of the inner conductors extending from each of the openings, the inner conductors being connected to the circuit pads with minimum slack therealong between the circuit pads and the openings, an insulating sleeve disposed within said outer conductor and adapted to accommodate said first and second inner conductors, said sleeve extending to the openings and said sleeve comprising a dielectric material having a predetermined coefficient of linear thermal expansion that substantially matches the coefficient of linear thermal expansion of the outer conductor over a normal microwave coupler operating temperature range so that the sleeve expands at substantially the same rate as the outer conductor thereby preventing tensioning and breakage of the inner conductor connections to the circuit pads.

22. A microwave coupled line device as set forth in claim 21 wherein said outer conductor comprises one of a copper-based alloy and aluminum.

23. A microwave coupled line device as set forth in claim 22 wherein said material comprises a TFE-based polymer compound.

24. A microwave coupled line device as set forth in claim 23 wherein said material has dielectric constant in the range of 2.9–3.5.

25. A microwave coupled line device as set forth in claim 24 wherein said compound includes synthetic mica filler to alter its coefficient of linear thermal expansion.

26. A microwave coupled line device as set forth in claim 25 wherein said compound comprises Fluorosint® 500.

27. A microwave coupled line device as set forth in claim 23 wherein said compound includes boron nitride to alter its coefficient of linear thermal expansion.

28. A microwave coupled line device as set forth in claim 27 wherein said compound comprises Flurolloy H®.

29. A microwave coupled line device as set forth in claim 21 wherein at least one end of said outer conductor is uncapped with the insulating sleeve and the inner conductors free to extend outwardly therefrom.

30. A microwave coupled line device as set forth in claim 29 wherein both ends of said outer conductor are uncapped with the insulating sleeve and the inner conductors free to extend respectively outwardly therefrom.

31. A microwave coupled line device as set forth in claim 30 wherein said outer conductor is cylindrical in shape.

32. A microwave coupled line device as set forth in claim 31 wherein said compound includes one of Fluorosint® 500 and Flurolloy H®.

33. Microwave coupler line device as set forth in claim 21 wherein the predetermined center frequency is no less than approximately 1 GHz.

34. Microwave coupler line device as set forth in claim 21 wherein the outer conductor is sized in length between each opening to no more than approximately three inches.

35. Microwave coupler line device as set forth in claim 21 wherein the outer conductor includes an outer width of no more than 0.25 inches taken through any cross section thereof.

* * * * *